US010264641B1

(12) United States Patent
Mays, II et al.

(10) Patent No.: US 10,264,641 B1
(45) Date of Patent: Apr. 16, 2019

(54) LIGHTING SYSTEM AND METHOD FOR DYNAMICALLY REGULATING DRIVEN CURRENT TO AN ANALOG OR DIGITAL DIMMING INTERFACE

(71) Applicant: UNIVERSAL LIGHTING TECHNOLOGIES, INC., Madison, AL (US)

(72) Inventors: Stephen D. Mays, II, Madison, AL (US); John J. Dernovsek, Madison, AL (US); Matthew Gann, Madison, AL (US); Dane Sutherland, II, Madison, AL (US)

(73) Assignee: Universal Lighting Technologies, Inc., Madison, AL (US)

( * ) Notice: Subject to any disclaimer, the term of this patent is extended or adjusted under 35 U.S.C. 154(b) by 16 days.

(21) Appl. No.: 15/825,944

(22) Filed: Nov. 29, 2017

Related U.S. Application Data

(60) Provisional application No. 62/528,773, filed on Jul. 5, 2017.

(51) Int. Cl.
*H05B 41/36* (2006.01)
*H05B 33/08* (2006.01)
*H05B 41/38* (2006.01)

(52) U.S. Cl.
CPC ..... *H05B 33/0845* (2013.01); *H05B 33/089* (2013.01); *H05B 33/0815* (2013.01); *H05B 41/38* (2013.01)

(58) Field of Classification Search
None
See application file for complete search history.

(56) References Cited

U.S. PATENT DOCUMENTS 5,039,914 A * 8/1991 Szuba ..... H05B 41/3922 315/158
5,089,751 A * 2/1992 Wong ..... H05B 41/28 315/279
6,144,539 A 11/2000 Konopka et al.
6,204,613 B1 * 3/2001 Hesterman ..... H05B 41/2851 315/291
6,356,027 B1 * 3/2002 Zhang ..... H02H 3/20 315/136
7,333,353 B2 2/2008 Yin
(Continued)

*Primary Examiner* — Crystal L Hammond
(74) *Attorney, Agent, or Firm* — Patterson Intellectual Property Law, P.C.; Gary L. Montle

(57) ABSTRACT

A lighting system includes various ballasts or LED drivers having respective dimming interface circuits coupled in parallel to an external dimming device. Each device includes a controller regulating output to a lighting load based on desired dimming output. Dimming interface circuits coupled are between the controller and the external dimming device, each configured to dynamically adapt a level of constant current sourced from the dimming interface circuit to the external dimming device via first and second interface terminals, based on a determined analog mode or digital mode associated with the external device. The dimming interface circuit generates dimming control signals to the controller based on dimming input signals received via the first and second interface terminals, and in a digital mode, the interface circuit generates digital pulse signals to the external dimming device via the interface terminals for bidirectional communications therewith.

20 Claims, 8 Drawing Sheets

(56) References Cited

U.S. PATENT DOCUMENTS

| | | | | |
|---|---|---|---|---|
| 7,750,577 | B2 | 7/2010 | Nerone et al. | |
| 8,654,485 | B1 | 2/2014 | Koehler | |
| 9,693,411 | B1 | 6/2017 | Xiong et al. | |
| 9,723,667 | B1 | 8/2017 | Xiong et al. | |
| 10,128,101 | B2 * | 11/2018 | Goscha | H01J 5/54 |
| 2009/0079357 | A1 | 3/2009 | Shteynberg et al. | |
| 2010/0102747 | A1 * | 4/2010 | Ilyes | H05B 37/0254 315/291 |
| 2010/0181935 | A1 | 7/2010 | Wu | |
| 2011/0285311 | A1 | 11/2011 | Yang et al. | |
| 2012/0249001 | A1 | 10/2012 | Okubo et al. | |
| 2013/0082604 | A1 | 4/2013 | Williams et al. | |
| 2014/0117868 | A1 | 5/2014 | Lopez et al. | |
| 2014/0125241 | A1 | 5/2014 | Elferich et al. | |
| 2014/0145607 | A1 * | 5/2014 | Goscha | H01J 65/048 315/53 |
| 2014/0253562 | A1 | 9/2014 | Yaras | |
| 2016/0242253 | A1 * | 8/2016 | Bhagwat | H05B 33/0815 |

* cited by examiner

LIGHTING SYSTEM AND METHOD FOR DYNAMICALLY REGULATING DRIVEN CURRENT TO AN ANALOG OR DIGITAL DIMMING INTERFACE

CROSS-REFERENCES TO RELATED APPLICATIONS

This application claims benefit of U.S. Provisional Patent Application No. 62/528,773, filed Jul. 5, 2017, and which is hereby incorporated by reference.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

BACKGROUND OF THE INVENTION

The present invention relates generally to dimming applications for lighting systems. More particularly, the present invention relates to a non-isolated dimming interface for a lighting device such as an electronic ballast or LED driver, having inherent overvoltage protection and the ability to dynamically adapt for operations with either of an analog or digital dimming device.

One purpose of an invention as disclosed herein is to provide a dimming interface for a lighting device (such as, e.g., an LED driver or electronic ballast) that can deliver a trickle current for an analog dimming interface or a digital load with digital communication capability. It would be desirable in view of the lack of practical alternatives in the prior art to further provide a dimming interface which is a voltage limited constant current source capable of changing the level of the driven current depending on whether it is delivering current to an analog interface or whether it is delivering a much larger current to a load.

It is conventionally known in the art to provide circuitry for protecting the dimming control interface in lighting devices against line voltages. In response to the application of line voltages, high impedance is often provided to limit current in the protection circuit, and clamping circuitry may be further provided to limit the output voltage from the protection circuit to the interface circuitry and the remainder of the lighting device generally. However, such circuits typically also utilize PTC thermistors or high voltage transistors to provide such protection, which increases the cost of the circuit. Accordingly, it would be desirable to provide a relatively low cost interface circuit with sufficient protection against the application of line voltages.

One example of a dimming interface circuit and method may be described with reference to U.S. Pat. No. 6,144,639, wherein a DC voltage is applied through a resistor network and a diode connected to the positive terminal, and an FET connected to the negative terminal, to establish a constant current from the analog interface circuit. Under normal loading conditions, the FET connected to the negative terminal is biased on so as to allow the constant current to flow out of the DC voltage source's positive terminal. An analog control signal is sensed between the diode and the current limiting resistors. If a large voltage was to be applied to the output terminals, either the diode would block current being driven into the circuit via the positive output terminal, or the high voltage FET would be negatively biased so as to block current being driven into the circuit via the negative output terminal. The diode and FET would accordingly protect against misapplication of the mains input voltage.

However, one disadvantage to this method is the fact the diode will distort the measure of the analog control voltage. Also, this circuit has no provisions for changing to a high current output to power (and potentially communicate with) an external dimming device.

Another conventional method may be briefly described by reference to FIGS. 1 and 2. This alternate method includes an interface circuit 100 that develops a constant current and measures the analog control voltage via an isolation transformer T1. An FET Q1 applies a DC power source to a primary winding of the flyback transformer T1B, which supplies current to a secondary winding T1C, and further enables sensing of the output voltage across first and second dimming interface wires (illustrated as "violet" and "grey") via a tertiary winding T1A.

In the circuit as shown, further depending on the component values and size of the associated components, misapplication of the mains input voltage can damage the secondary components. The resistors R3, R4, R5, and R8 in the grey wire return path of the secondary circuit in FIG. 2 develop an offset voltage that is transferred to the tertiary winding T1A. As such, the offset must be subtracted before attenuating to a useable level, which requires a relatively expensive, low supply current reference voltage device D7 to subtract off most of the offset.

To reduce construction costs for the isolation transformer and associated circuitry, much of the circuitry from FIGS. 1 and 2 can be moved to use the same circuit ground as the output LED drive circuitry. However, while this can reduce costs, components such as shunt regulator U1 become vulnerable to mis-wiring, which leads to field failures.

BRIEF SUMMARY OF THE INVENTION

Various embodiments are disclosed herein for a dimming interface for a lighting device such as an LED driver or ballast. The lighting device receives dimming control information from the dimming interface, and also provides the power source for the dimming interface, which acts as a load.

In one exemplary aspect, the interface can change 'profiles', i.e., from analog to digital or vice-versa. The dimming interface may accordingly provide a voltage limited constant current source capable of changing the level of the driven current, depending on whether it is configured for delivering current to an analog interface or whether it is delivering a much larger current to a load. The current source can be gated on or off so as, for example, to send marks and spaces to the digital load.

In another exemplary aspect, first stage protection against misapplication of an over-voltage is inherent to the design. In one embodiment, a diode may be provided to block current from being driven back into the circuit in one direction, and the current source is created by a high voltage switching element (e.g., PNP transistor) that will prevent the circuit from becoming damaged via current being sunk by a low voltage source in the opposite direction. These two elements may preferably be connected in series so as to avoid damage from misapplied mains input voltage across the interface terminals.

In another exemplary aspect, bi-directional communication with a digital dimming device is made possible, without the need of a shorting device on the output of the interface.

In another exemplary aspect, the nature of the output of the dimming interface is such that it can be coupled in parallel with like interfaces of other ballasts or LED drivers, so as to be able to control multiple ballasts or LED drivers simultaneously.

In another exemplary aspect, serial data from the digital dimming interface can be sent to a remote device via either a modulated current or a modulated voltage.

In another exemplary aspect, the output current and other operating parameters of the LED driver or ballast can be modified via a digital dimming command. To receive data from the digital dimming load, the circuit measures the current consumed by the load. If the load accepts the current, it is considered a mark. If the load denies the current, it is considered a space.

In another exemplary aspect, the circuit can accurately measure and convey the power consumed by the dimming interface.

In another exemplary aspect, sensitive circuit components that could otherwise be damaged by an over-voltage condition (e.g., via misapplication of a mains input) are provided with inherent protection.

In another exemplary aspect, the output may be thermally compensated throughout the full temperature range of a safe operating area of the device.

In another exemplary aspect, the circuit is designed such that it can be tailored for a particular level of misapplication of over-voltage. For example, if the highest possible voltage against which the interface needs to be protected is relatively low, the output switching element and diode can be a 60V transistor and a 75V diode, respectively. In the alternative, if the highest possible voltage against which the interface needs to be protected is for a mains input connection, the output switching element and diode can be designed as a 500V transistor and a 500V diode, respectively.

In another exemplary aspect, the nature of the protection circuit does not require electrical isolation from the LED driver or ballast output in order to be effective.

DETAILED DESCRIPTION OF THE INVENTION

Figure 1:
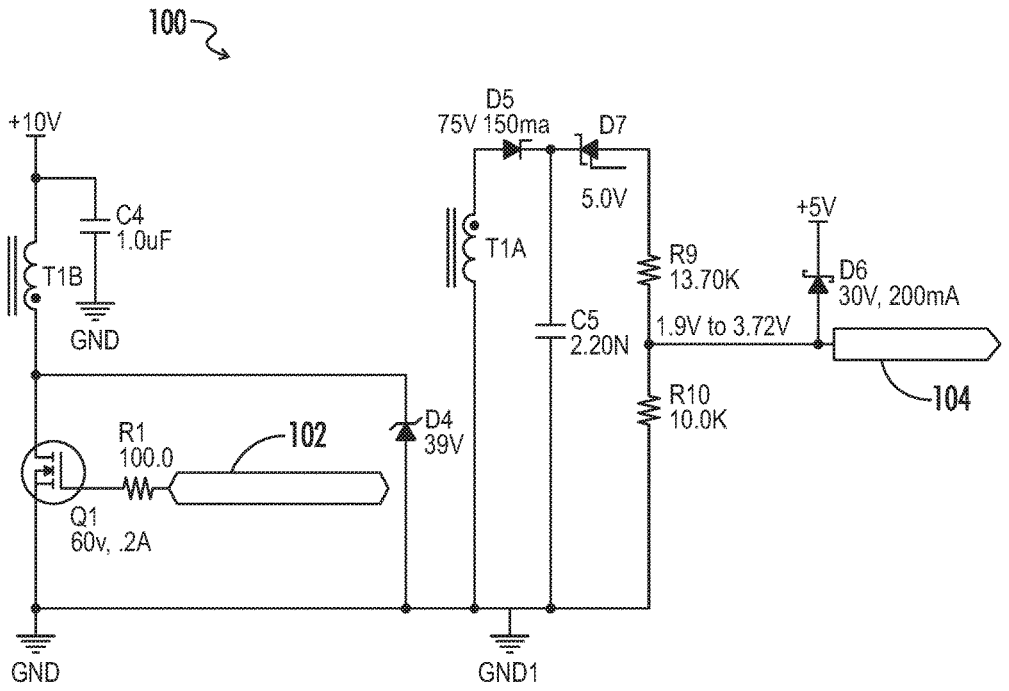
FIG. 1 (PRIOR ART)
FIGS. 1 and 2 are circuit block diagrams for a dimming interface as previously known in the art.
Figure 2:
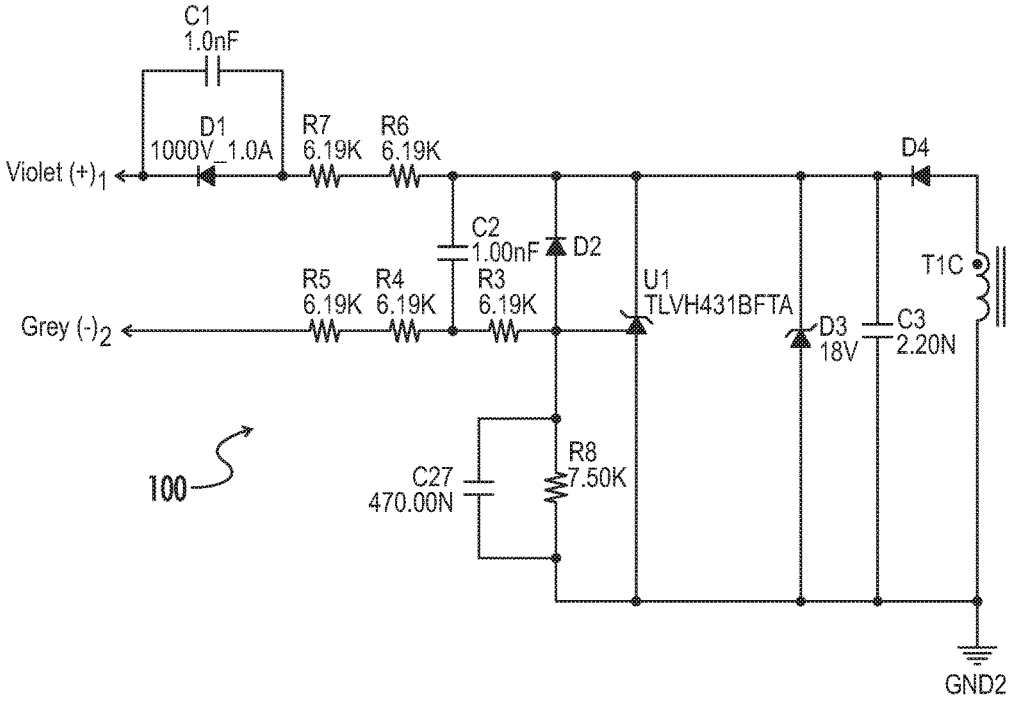
FIG. 2 (PRIOR ART)

Referring generally to FIGS. 3-12, various exemplary embodiments of an inventive dimming controller and lighting system may now be described in detail. Where the various figures may describe embodiments sharing various common elements and features with other embodiments, similar elements and features are given the same reference numerals and redundant description thereof may be omitted below.

Figure 3:
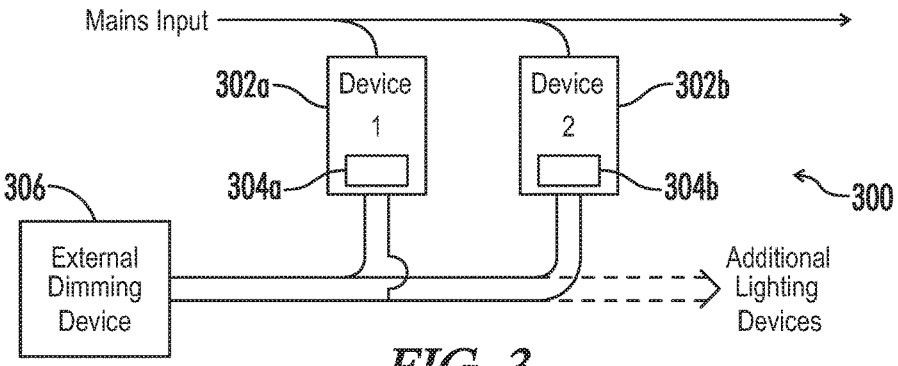
FIG. 3 is a simplified block diagram representing an embodiment of a lighting system as disclosed herein.

Referring first to FIG. 3, an exemplary lighting system 300 as disclosed herein may include a plurality of lighting devices 302*a*, 302*b* each coupled to receive mains power input. The scope of an invention as disclosed herein is not necessarily limited to such a system unless otherwise stated, as various embodiments of an invention may be described with respect to a single lighting device 302, or further with respect merely to a dimming interface 304 as relating to a single lighting device. However, a plurality of lighting devices 302*a*, 302*b* as further including respective dimming interfaces 304*a*, 304*b* as disclosed herein may in a particular embodiment be coupled in parallel to a single external dimming device 306 so as, for example, to receive dimming control commands simultaneously.

Figure 4:
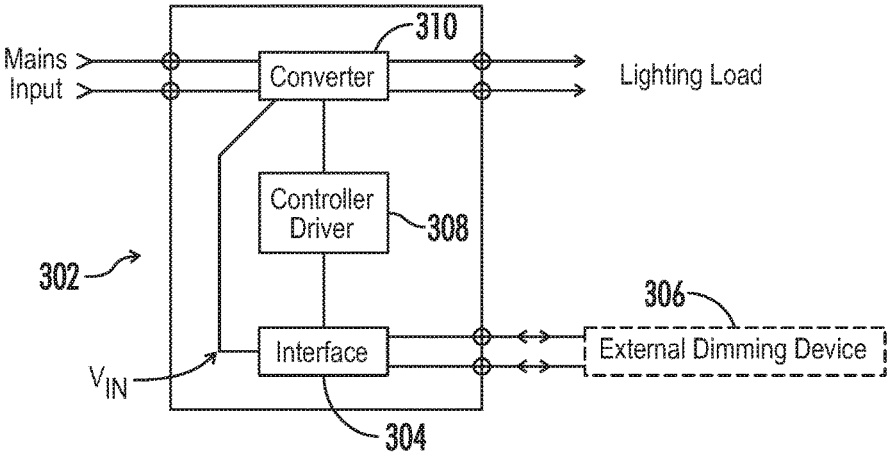
FIG. 4 is a simplified block diagram representing an embodiment of a lighting device as disclosed herein.

As shown in FIG. 4, an exemplary lighting device 302 may be provided with a power converter 310 that receives a mains power input and converts the input power to an output power for driving a lighting load. In one example, the power converter may be configured to provide DC power for driving an array of light emitting diodes, and in another example the power converter may be configured to provide AC power for a lighting load such as a fluorescent lamp. The output power may be regulated at least in part by a controller and/or one or more drivers 308 which produces control signals to one or more switching elements associated with the power converter to regulate an operating frequency thereof. The control signals from the controller/driver circuit 308 may be based upon a number of factors, such as preset values, load conditions, and the like, but also based at least in part on dimming control signals which may be provided from the dimming interface 304, themselves based on dimming input signals received from an external dimming device 306.

Figure 5:
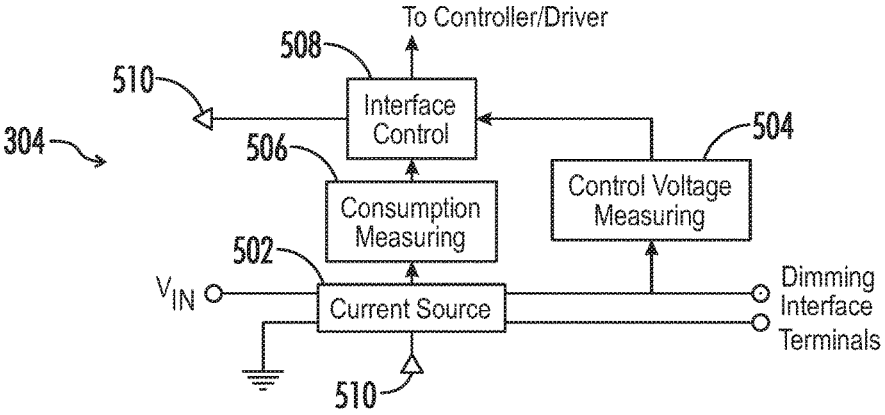
FIG. 5 is a simplified block diagram representing an embodiment of a dimming interface circuit as disclosed herein.

Referring now to FIG. 5, a simplified diagram illustrates a particular embodiment of a dimming interface 304. The dimming interface 304 receives input voltage from the lighting device 302 and also acts as a current source 502 with respect to a load coupled thereto via first and second interface terminals. A control voltage measuring circuit 504 may be coupled to at least the first interface terminal and provides feedback to a dimming interface control circuit 508. A power consumption measuring circuit 506 may also be coupled to measure power consumption by the dimming interface circuitry, and further provides feedback to the dimming interface control circuit 508. The dimming interface control circuit 508 provides dimming control signals to the lighting device controller 308 for output regulation, and also provides control signals to switching elements in the current source circuit 510 to regulate an amount of current driven through to the interface terminal, and/or to communicate with a remote dimming device via, e.g., a digital pulse train.

In various embodiments as disclosed herein, the dimming interface circuit 304 further automatically detects a type of external dimming device coupled thereto via the first and second interface terminals, and dynamically adapts a level of constant current sourced therefrom to the external dimming device, based at least on the detected type of the external dimming device being analog or digital The aforementioned dimming interface components and associated features will be described in more detail, without necessarily limiting the scope of an invention as disclosed herein. Each of the aforementioned and further described components are not required in association with an inventive circuit, device or system unless otherwise stated.

Figure 6:
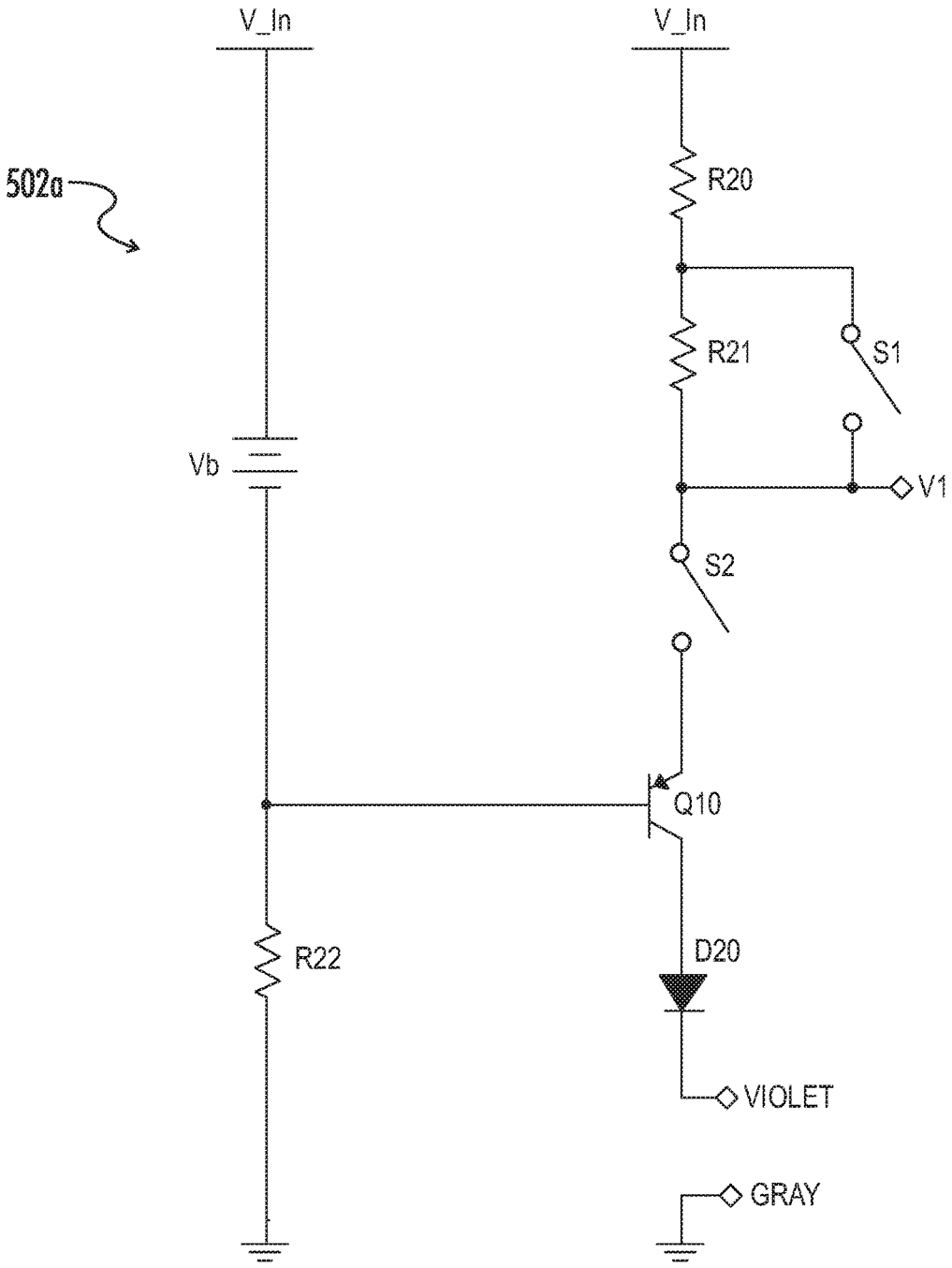
FIG. 6 is a circuit diagram representing an embodiment of a current source circuit of a dimming interface as disclosed herein.

Referring now to FIG. 6, an exemplary embodiment of the dimming interface as disclosed herein includes a constant current source 502 based around a switching element Q10 such as for example a PNP transistor with a reverse bias current blocking PN junction diode. The output current source is sensed and regulated by resistors R20 and R21 coupled in series, and device Vb. Device Vb is shown as a battery, but could be any current driven voltage reference device, such as for example a Zener diode, diode-connected transistor, shunt regulator, or an adjustable shunt regulator.

Switching elements S1, S2 can be transistors such as NPN or PNP transistors, or could be MOSFETs such as a P-Channel FET. By shorting out or releasing resistor R21, operation of the first switching element S1 controls the quantity of current driven out via the VIOLET terminal. With the first switching element S1 closed, for example, the output current can be driven at the maximum design level. The second switching element S2 gates the driven current, allowing the circuit to drive current through a load or to deny current to the load.

Regulation of the second switching element S2 may serve multiple purposes. For example, if an excessively high voltage was applied to the circuit, the second switching element S2 may be closed, allowing the switching element Q10 and the blocking diode D20 to function as part of a protection circuit as further described herein. Also, if the VIOLET and GRAY dimming interface terminals are shorted while the first switching element S1 is closed, the second switching element S2 may be cycled by opening so as to reduce power stress to switch Q10, and then closing to determine whether the short was removed.

When a digital dimming interface is connected via the interface terminals, digital serial data may be sent to it from the circuit 502*a* by modulating its driven current. Modulation may be implemented, for example, by employing ON-OFF keying. The data may be pulse modulated using a non-return-to-zero (NRZ) code at a high data rate, or the data could be modulated as Manchester code at a lower data rate. One of skill in the art may appreciate that whereas the circuit 502*a* is configured for powering the digital dimming interface, sending a series of spaces would starve power to the device, and therefore the pulse train would have to be selected so as to guarantee the average delivered power is sufficient.

In an embodiment, the voltage ratings of switch Q10 and diode D20 may be selected based on a required voltage protection. If protection against misapplication of the mains input is required, for example, a 500V FET may be selected along with a diode rated for a minimum of 500V.

With the second switching element S2 closed and the first switching element S1 open, the exemplary circuit 502*a* can withstand indefinite misapplication of the mains input voltage or another excessively high voltage. If the voltage across the interface terminals VIOLET and GREY exceeds the input voltage V_in, the diode D20 will block any current up to its maximum voltage rating. If the voltage across the interface terminals VIOLET and GREY is negative, the switch Q10 will continue driving a low current until the voltage difference between the base of the switch Q10 and the voltage of the VIOLET interface terminal exceeds the voltage rating of the switch Q10.

Figure 7:
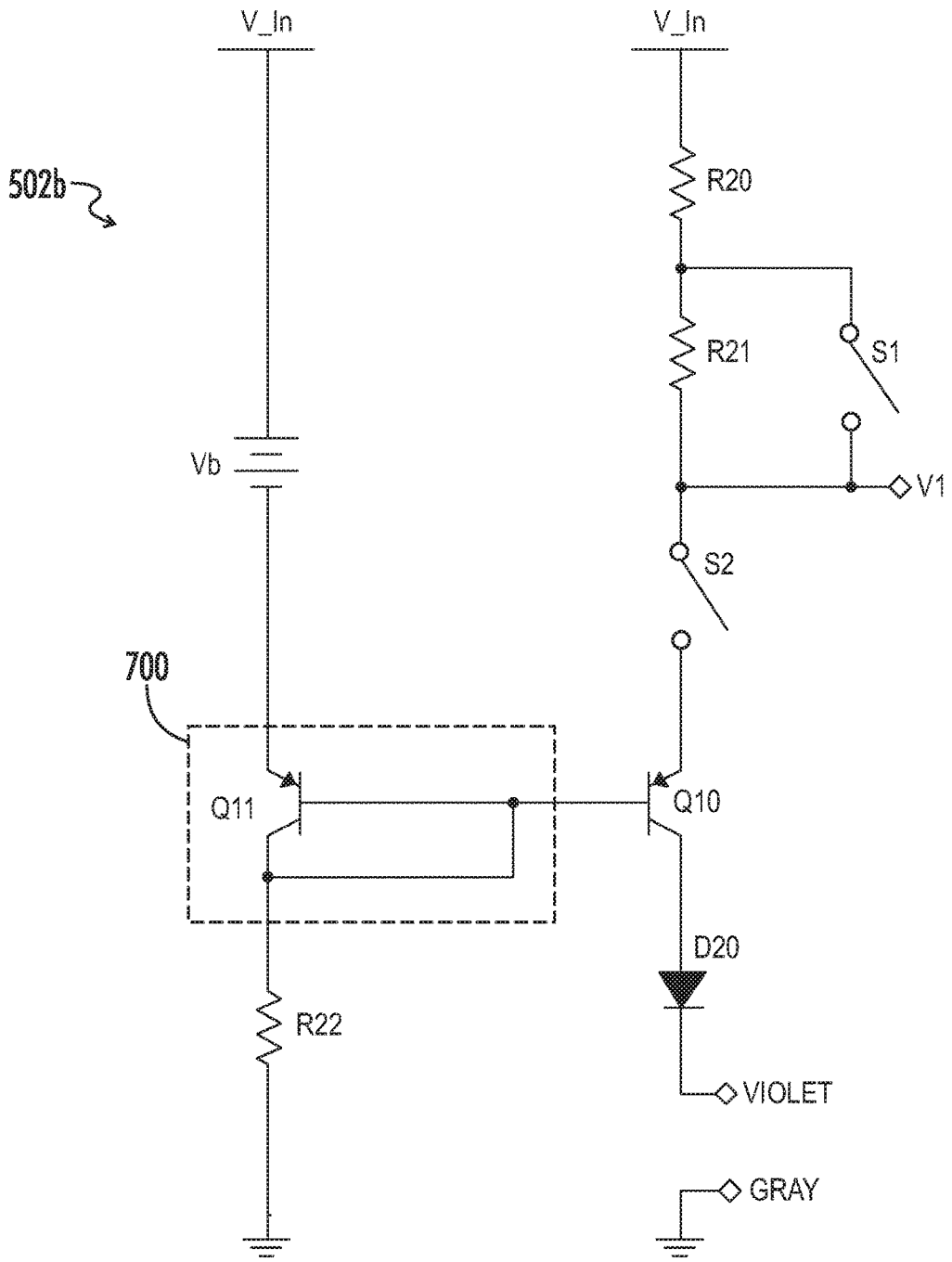
FIG. 7 is a circuit diagram representing another embodiment of the current source circuit as disclosed herein, further including a thermal compensation circuit.

In another embodiment of the circuit 502*b*, a thermal compensation circuit 700 may be added. This may be desirable as the magnitude of the driven current may be skewed due to error caused by the emitter-base junction voltage of the switch Q10. When the constant current source circuit 502 operates in an elevated ambient temperature, the error will be increased significantly as the emitter-base junction voltage changes inversely as a function of temperature. To compensate for this error throughout the full temperature range of a safe operating area of the device, a fourth switching element Q11 such as a diode connected PNP transistor can be added as shown in FIG. 7.

Figure 8:
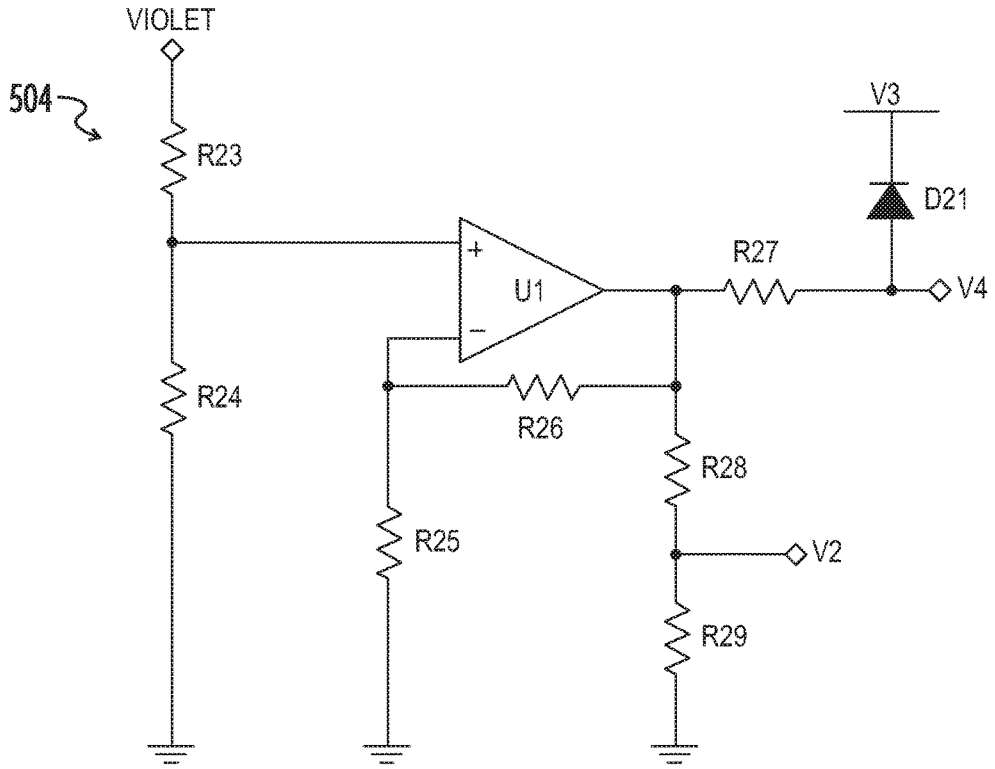
FIG. 8 is a circuit diagram representing an embodiment of a control voltage measurement circuit of a dimming interface as disclosed herein.

Referring now to FIG. 8, an embodiment of a control voltage measurement circuit 504 may be described in more detail. To measure the analog control voltage, the voltage across the dimming interface terminals VIOLET and GREY are measured directly via an attenuation network. The circuit 504 will attenuate the analog control voltage using a high value string of resistors including resistors R23, R24. The high value of the resistors may be selected to survive misapplication of the mains input. In particular, resistor R23 may be designed to be significantly greater than resistor R24 and thereby to drop the majority of a misapplied mains input across itself so as to protect the input of amplifier U1. The attenuated analog control voltage will be buffered and amplified and made available as analog control voltage feedback signal V2. Using the illustrated circuit 504, a very linear and accurate measurement of the analog control voltage may be provided.

If the circuit 504 is connected to a digital dimming interface, the digital dimming interface may send marks and spaces in a pulse train pattern by shorting the VIOLET and GRAY wires. The output of amplifier U1 in this event will exceed the power supply V3 for the digital data interpreter, e.g., dimming controller 508, and will saturate a first digital feedback signal V4 so as to develop a digital pulse train to be submitted to the digital data interpreter 508.

Figure 9:
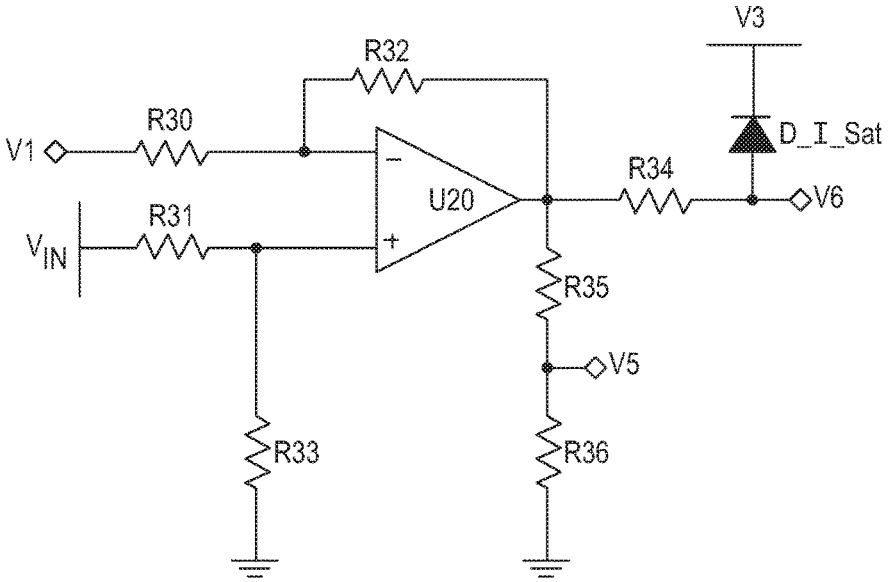
FIG. 9 is a circuit diagram representing an embodiment of a consumption measurement circuit of a dimming interface as disclosed herein.

Referring next to FIG. 9, an embodiment of a current consumption measurement circuit 506 may now be described in more detail. The illustrated circuit 506 includes a traditional differential amplifier configuration designed to measure the current consumed by a digital dimming interface 502 in a linear and accurate manner. For example, it is desirable in the LED driver market for LED drivers to be able to report input power consumed thereby. To maintain accuracy of the overall power consumption measurement, the power consumed by the digital dimming interface must also be taken into account, which requires a measurement of the loaded voltage V2 (as provided from the circuit 504 in FIG. 8) and a voltage representative of the consumed current V5 (as provided from the circuit 506 in FIG. 9).

In an embodiment as shown, the circuit 506 will saturate a second digital feedback signal V6 so as to reduce the measured consumed current to a digital signal. If the dimming interface is digital, the digital dimming interface can send marks and spaces in a pulse train pattern by accepting and blocking current driven by the circuit 502.

In an embodiment as shown, the current flowing through the VIOLET interface terminal is measured by measuring the voltage across resistors R20 and R21 from FIG. 6. As an alternate method (not shown), a third resistor could be added in series with the first two resistors R20 and R21, and its voltage could be measured differentially.

By implementing a preferred embodiment wherein the voltage is measured across the resistors R20 and R21, several advantages may be realized. First, the current flowing through high and low differential resistors R31 and R33 from the input voltage V_in will not skew the accuracy of the measured current. Also, as the current source circuit 502 changes from a low output current to a high output current (or vice-versa), the first gain stage, i.e. the current to voltage transformation via resistors R20 and R21, will change its gain so as to develop full range output voltage at full output current, yielding a more linear measurement of the consumed current. The aforementioned embodiment further may be advantageous in that it requires fewer components.

Figure 10:
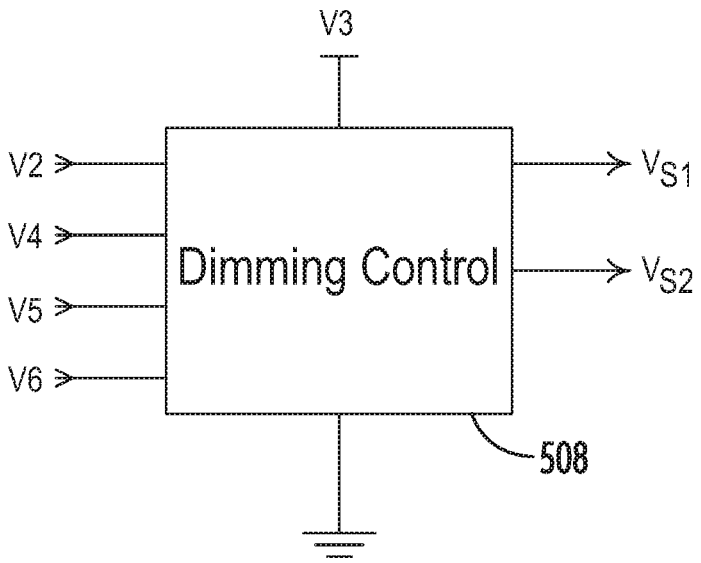
FIG. 10 is a circuit block diagram representing an embodiment of a dimming controller and associated inputs and outputs for a dimming interface as disclosed herein.

An exemplary diagram of an input and output scheme for the dimming controller 508 is shown on FIG. 10. The controller 508 as disclosed in the aforementioned embodiments may generally be coupled to a power supply V3 and further receive feedback inputs corresponding to the voltage across the dimming interface terminals as an analog control voltage V2, encoded data via a modulated voltage (i.e., via dimming interface terminals shorted and released) V4, the current consumed by the dimming interface circuit V5 and encoded data via a modulated current (i.e., via current accepted and blocked) V6. The controller further generates control signals Vs1 and Vs2 to regulate operation of the first switching element S1 and second switching element S2 in circuit 502 for regulating the output current, for example based in part on whether the dimming interface is operating in analog or digital mode.

In one embodiment, whether the dimming interface circuit 304 is in analog dimming mode or digital dimming mode may be predetermined by programming the circuit (i.e., flashing the controller) during manufacturing to act in the appropriate mode.

Figure 11:
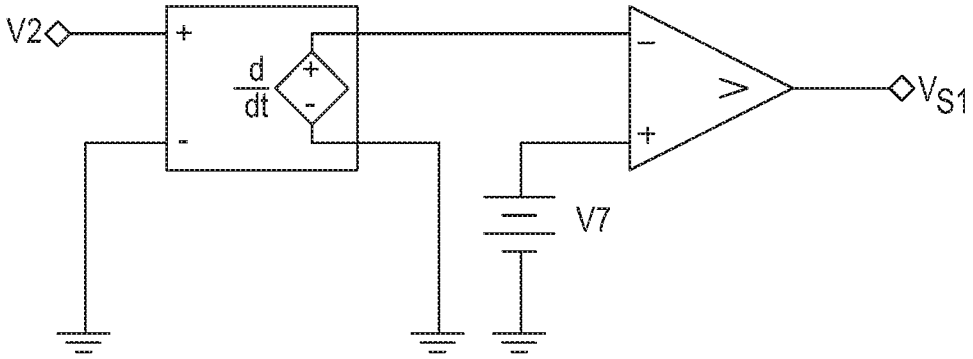
FIG. 11 is a simplified block diagram representing an embodiment of an auto-detection circuit for a dimming interface as disclosed herein.

In an alternative method, the nature of the dimming interface may be automatically detected by analyzing the slope of the analog control signal V2 immediately after closing the first switching element S1 when the lighting device (i.e., LED driver) is powered up. FIG. 11 illustrates a basic circuit to illustrate the auto-detection process, wherein the voltage V2 across the interface terminals VIOLET and GREY is sampled over time and compared to a voltage V7 corresponding to the slope.

Figure 12:
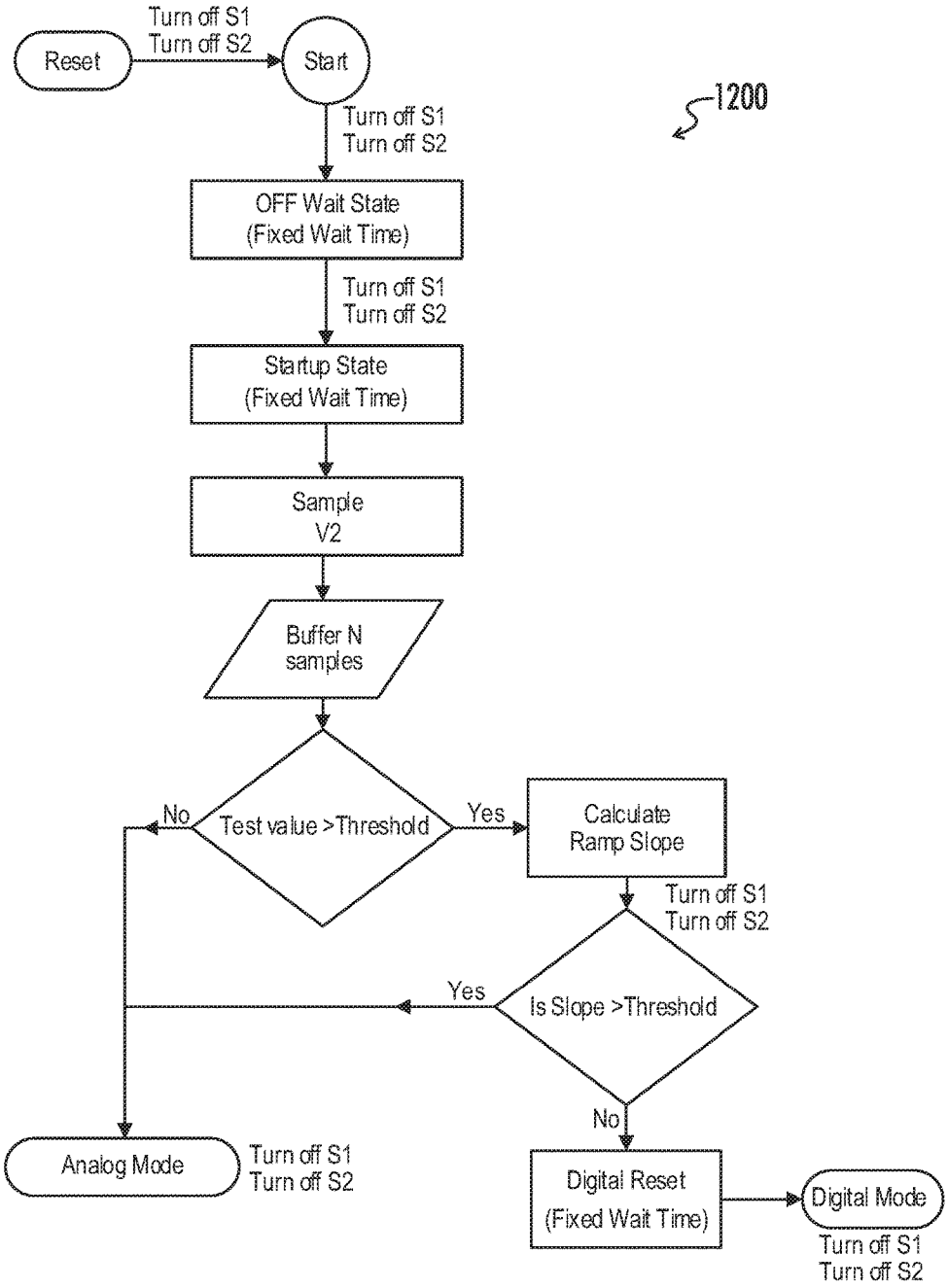
FIG. 12 is a flowchart representing an embodiment of an auto-detection methodology as implemented in the dimming controller as disclosed herein.

Rather than implementing this in additional hardware, as a preferred embodiment this can be implemented in the controller in the context of an algorithm as illustrated in FIG. 12. In other words, following a reset and power up of the lighting device, each of the switching elements S1 and S2 are controlled off. After an initial fixed wait time, the second switching element S2 is turned on. After a subsequent fixed wait time for startup, the voltage V2 across the interface terminals is sampled and buffered for an amount of samples N. If the tested value does not exceed a threshold value, the dimming interface circuit may be deemed as operating in the analog mode, wherein the first switching element S1 is turned off and the second switching element S2 is turned on. If the tested value exceeds the first threshold value, the ramp slope of the analog control signal is calculated and compared to a second threshold value. If the calculated slope exceeds the second threshold value, the dimming interface circuit may once again be deemed as operating in analog mode, wherein the first switching element S1 is turned off and the second switching element S2 is turned on. However, if the calculated slope does not exceed the second threshold value, the dimming interface circuit may be deemed as operating in digital mode. Both switching elements S1 and S2 are turned off for a fixed wait time, and then turned on.

Although not shown in FIG. 12, in one embodiment the voltage V5 corresponding to the consumed current could also be used for auto-detection. When implemented together, the voltage V2 and the voltage V5 can be used to calculate the consumed power or the resistance of the unknown dimming interface to enhance the characterization of the attached device. For example, a digital dimming interface may be equipped with a regulating switching converter that can dynamically change its impedance. In this scenario, tracking the change in impedance may yield fewer false detections.

When in analog dimming mode, the dimming controller 508 repeatedly samples and processes the analog control voltage V2 and adjusts the set point to the controller 308 responsible for adjusting the output current of the LED driver or ballast to the LED or fluorescent lamp.

When in digital dimming mode, the current source circuit 502 delivers a voltage limited constant current to the attached digital dimming device 306 to power the attached device 306. The attached digital dimming device 306 sends commands and queries to the circuit 502 via a serial data stream modulated in, e.g., an NRZ or Manchester bit pattern.

If the data is sent via a modulated voltage, i.e. the voltage across the VIOLET and GREY wires is shorted and released, the analog control measurement circuit 504 will reduce the modulated voltage to logic levels that can be decoded by the controller 508.

If the data is sent via a modulated current, i.e. the current delivered to the digital dimming device is accepted or blocked by the digital dimming device, the current consumption measurement circuit 506 will reduce the modulated current to logic levels that can be decoded by the controller 508.

The dimming controller 508 will accumulate the serial data, parse the received packets, adjust the set point to the LED driver or ballast controller 308 (as needed), formulate a reply, and drive a reply data stream back out the first dimming interface terminal (VIOLET wire).

To send data out the first dimming interface terminal, current is allowed to flow out the terminal by closing the second switching element S2 to form marks, and current is blocked from the first dimming interface terminal by opening the second switching element S2 to form spaces. These marks and spaces are interpreted by the digital dimming interface by reducing the measured delivered current to a logic level and are accumulated by the controller to form packets of data.

When in digital mode, the controller 508 can repeatedly sample and process both of the analog control voltage V2 and the voltage corresponding to the consumed current V5 to calculate the power consumed by the attached digital dimming device 306. This data can be combined with the power consumed by the output LED or fluorescent lamp load to provide a more accurate report of total power consumed by the LED driver or ballast and can be queried and distributed by the attached digital dimming interface 306.

Since the digital interface 304 is primarily a current source, the digital interfaces of multiple LED drivers or ballasts 302 can be coupled together in a parallel configuration, enabling the end user to reduce costs by pairing only one digital dimming device 306 with multiple LED drivers or ballasts 302.

Throughout the specification and claims, the following terms take at least the meanings explicitly associated herein, unless the context dictates otherwise. The meanings identified below do not necessarily limit the terms, but merely provide illustrative examples for the terms. The meaning of "a," "an," and "the" may include plural references, and the meaning of "in" may include "in" and "on." The phrase "in one embodiment," as used herein does not necessarily refer to the same embodiment, although it may.

The term "coupled" means at least either a direct electrical connection between the connected items or an indirect connection through one or more passive or active intermediary devices. The term "circuit" means at least either a single component or a multiplicity of components, either active and/or passive, that are coupled together to provide a desired function. Terms such as "wire," "wiring," "line," "signal," "conductor," and "bus" may be used to refer to any known structure, construction, arrangement, technique, method and/or process for physically transferring a signal from one point in a circuit to another. Also, unless indicated otherwise from the context of its use herein, the terms "known," "fixed," "given," "certain" and "predetermined" generally refer to a value, quantity, parameter, constraint, condition, state, process, procedure, method, practice, or combination thereof that is, in theory, variable, but is typically set in advance and not varied thereafter when in use.

The terms "switching element" and "switch" may be used interchangeably and may refer herein to at least: a variety of transistors as known in the art (including but not limited to FET, BJT, IGBT, IGFET, etc.), a switching diode, a silicon controlled rectifier (SCR), a diode for alternating current (DIAC), a triode for alternating current (TRIAC), a mechanical single pole/double pole switch (SPDT), or electrical, solid state or reed relays. Where either a field effect transistor (FET) or a bipolar junction transistor (BJT) may be employed as an embodiment of a transistor, the scope of the terms "gate," "drain," and "source" includes "base," "collector," and "emitter," respectively, and vice-versa.

The terms "power converter" and "converter" unless otherwise defined with respect to a particular element may be used interchangeably herein and with reference to at least DC-DC, DC-AC, AC-DC, buck, buck-boost, boost, half-bridge, full-bridge, H-bridge or various other forms of power conversion or inversion as known to one of skill in the art.

The terms "controller," "control circuit" and "control circuitry" as used herein may refer to, be embodied by or otherwise included within a machine, such as a general purpose processor, a digital signal processor (DSP), an application specific integrated circuit (ASIC), a field programmable gate array (FPGA) or other programmable logic device, discrete gate or transistor logic, discrete hardware components, or any combination thereof designed and programmed to perform or cause the performance of the functions described herein. A general purpose processor can be a microprocessor, but in the alternative, the processor can be a microcontroller, or state machine, combinations of the same, or the like. A processor can also be implemented as a combination of computing devices, e.g., a combination of a DSP and a microprocessor, a plurality of microprocessors, one or more microprocessors in conjunction with a DSP core, or any other such configuration.

Depending on the embodiment, certain acts, events, or functions of any of the algorithms described herein can be performed in a different sequence, can be added, merged, or left out altogether (e.g., not all described acts or events are necessary for the practice of the algorithm). Moreover, in certain embodiments, acts or events can be performed concurrently, e.g., through multi-threaded processing, interrupt processing, or multiple processors or processor cores or on other parallel architectures, rather than sequentially.

The various illustrative logical blocks, modules, and algorithm steps described in connection with the embodiments disclosed herein can be implemented as electronic hardware, computer software, or combinations of both. To clearly illustrate this interchangeability of hardware and software, various illustrative components, blocks, modules, and steps have been described above generally in terms of their functionality. Whether such functionality is implemented as hardware or software depends upon the particular application and design constraints imposed on the overall system. The described functionality can be implemented in varying ways for each particular application, but such implementation decisions should not be interpreted as causing a departure from the scope of the disclosure.

The steps of a method, process, or algorithm described in connection with the embodiments disclosed herein can be embodied directly in hardware, in a software module executed by a processor, or in a combination of the two. A software module can reside in RAM memory, flash memory, ROM memory, EPROM memory, EEPROM memory, registers, hard disk, a removable disk, a CD-ROM, or any other form of computer-readable medium known in the art. An exemplary computer-readable medium can be coupled to the processor such that the processor can read information from, and write information to, the memory/storage medium. In the alternative, the medium can be integral to the processor. The processor and the medium can reside in an ASIC. The ASIC can reside in a user terminal. In the alternative, the processor and the medium can reside as discrete components in a user terminal.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment.

The previous detailed description has been provided for the purposes of illustration and description. Thus, although there have been described particular embodiments of a new and useful invention, it is not intended that such references be construed as limitations upon the scope of this invention except as set forth in the following claims.

What is claimed is:

1. A lighting device comprising:

a power converter configured to provide output power to a lighting load;

a controller configured to regulate operation of the power converter based at least in part on a desired dimming output for the lighting load; and a dimming interface circuit comprising:

a first circuit coupled across the first and second interface terminals and comprising at least one switching element controlled on and off to regulate a level of current sourced from the dimming interface circuit to an external dimming device coupled across the first and second interface terminals, and a second circuit coupled in parallel with the first circuit and configured to measure a control voltage across the first and second interface terminals, wherein the dimming interface circuit is configured to automatically detect a type of external dimming device coupled to the first and second interface terminals as being analog, based on a sampled measurement of the control voltage across the first and second interface terminals as having a calculated ramp slope greater than a threshold value, or digital, based on the sampled measurement of the control voltage across the first and second interface terminals as having the calculated ramp slope less than the threshold value, dynamically adapt a level of constant current sourced from the dimming interface circuit to the external dimming device via the first and second interface terminals, based at least on the detected type of the external dimming device being analog or digital, and generate dimming control signals to the controller based on dimming input signals from the external dimming device via the first and second interface terminals.

2. The lighting device of claim 1, comprising a plurality of switching elements coupled in series with the first interface terminal, wherein at least a first switching element of the plurality of switching elements is controlled on and off to regulate the current source level, and wherein at least a second switching element of the plurality of switching elements is controlled on and off to generate a digital pulse stream for bidirectional communications with a digital type of external dimming device.

3. The lighting device of claim 2, further comprising voltage protection circuitry coupled between the second switching element and the first interface terminal and configured in association with operation of at least the second switching element to withstand a misapplication of mains input voltage across the first and second interface terminals.

4. The lighting device of claim 3, wherein the voltage protection circuitry comprises a third switching element and a reverse bias current blocking diode coupled in series between the second switching element and the first interface terminal.

5. The lighting device of claim 4, wherein the second switching element is controlled, responsive to a detected short across the first and second interface terminals, to alternatively open so as to reduce stress to the third switching element and close so as to determine a continued presence of the detected short.

6. The lighting device of claim 4, further comprising a thermal compensation circuit configured to compensate for errors caused by temperature-driven changes in voltage across the third switching element, the thermal compensation circuit comprising a fourth switching element coupled to a control electrode of the third switching element.

7. A lighting device comprising:

a power converter configured to provide output power to a lighting load;

a controller configured to regulate operation of the power converter based at least in part on a desired dimming output for the lighting load; and a dimming interface circuit comprising:

a first circuit coupled across the first and second interface terminals and comprising at least one switching element controlled on and off to regulate a level of current sourced from the dimming interface circuit to an external dimming device coupled across the first and second interface terminals, a second circuit coupled in parallel with the first circuit and configured to measure a control voltage across the first and second interface terminals, and a third circuit configured to measure an amount of current consumed by the dimming interface circuit, wherein the dimming interface circuit is configured to automatically detect a type of external dimming device coupled to the first and second interface terminals based on the measured control voltage across the first and second interface terminals and the measured amount of current consumed by the dimming interface circuit, dynamically adapt a level of constant current sourced from the dimming interface circuit to the external dimming device via the first and second interface terminals, based at least on the detected type of the external dimming device being analog or digital, and generate dimming control signals to the controller based on dimming input signals from the external dimming device via the first and second interface terminals.

8. The lighting device of claim 7, wherein the first circuit comprises first and second resistors coupled in series to a first input voltage terminal, and the first circuit comprises a first switching element coupled in parallel with the second resistor and at least a second switching element coupled between the second resistor and the first interface terminal, wherein the third circuit is configured to compare an input voltage to the dimming interface circuit against a voltage across the first and second resistors.

9. The lighting device of claim 7, comprising a plurality of switching elements coupled in series with the first interface terminal, wherein at least a first switching element of the plurality of switching elements is controlled on and off to regulate the current source level, and wherein at least a second switching element of the plurality of switching elements is controlled on and off to generate a digital pulse stream for bidirectional communications with a digital type of external dimming device.

10. The lighting device of claim 9, further comprising voltage protection circuitry coupled between the second switching element and the first interface terminal and configured in association with operation of at least the second switching element to withstand a misapplication of mains input voltage across the first and second interface terminals.

11. The lighting device of claim 10, wherein the voltage protection circuitry comprises a third switching element and a reverse bias current blocking diode coupled in series between the second switching element and the first interface terminal.

12. The lighting device of claim 11, wherein the second switching element is controlled, responsive to a detected short across the first and second interface terminals, to alternatively open so as to reduce stress to the third switching element and close so as to determine a continued presence of the detected short.

13. The lighting device of claim 11, further comprising a thermal compensation circuit configured to compensate for errors caused by temperature-driven changes in voltage across the third switching element, the thermal compensation circuit comprising a fourth switching element coupled to a control electrode of the third switching element.

14. A lighting device comprising:

a power converter configured to provide output power to a lighting load;

a controller configured to regulate operation of the power converter based at least in part on a desired dimming output for the lighting load;

first and second interface terminals configured to receive corresponding terminals of an external dimming device;

a plurality of switching elements coupled in series with the first interface terminal, wherein at least a first switching element of the plurality of switching elements is controlled on and off to regulate the current source level, wherein at least a second switching element of the plurality of switching elements is controlled on and off to generate a digital pulse stream for bidirectional communications with a digital type of external dimming device; and a dimming interface circuit configured to automatically detect a type of external dimming device coupled to the first and second interface terminals, dynamically adapt a level of constant current sourced from the dimming interface circuit to the external dimming device via the first and second interface terminals, based at least on the detected type of the external dimming device being analog or digital, and generate dimming control signals to the controller based on dimming input signals from the external dimming device via the first and second interface terminals.

15. The lighting device of claim 14, further comprising voltage protection circuitry coupled between the second switching element and the first interface terminal and configured in association with operation of at least the second switching element to withstand a misapplication of mains input voltage across the first and second interface terminals.

16. The lighting device of claim 15, wherein the voltage protection circuitry comprises a third switching element and a reverse bias current blocking diode coupled in series between the second switching element and the first interface terminal.

17. The lighting device of claim 16, wherein the second switching element is controlled, responsive to a detected short across the first and second interface terminals, to alternatively open so as to reduce stress to the third switching element and close so as to determine a continued presence of the detected short.

18. The lighting device of claim 16, further comprising a thermal compensation circuit configured to compensate for errors caused by temperature-driven changes in voltage across the third switching element, the thermal compensation circuit comprising a fourth switching element coupled to a control electrode of the third switching element.

19. The lighting device of claim 14, further comprising a circuit configured to measure a control voltage across the first and second interface terminals, wherein the dimming interface circuit is configured to automatically detect a type of external dimming device coupled to the first and second interface terminals as being analog, based on a sampled measurement of the control voltage across the first and second interface terminals as having a calculated ramp slope greater than a threshold value, or digital, based on the sampled measurement of the control voltage across the first and second interface terminals as having the calculated ramp slope less than the threshold value.

20. The lighting device of claim 14, further comprising:

a circuit configured to measure a control voltage across the first and second interface terminals; and a circuit configured to measure an amount of current consumed by the dimming interface circuit, wherein the dimming interface circuit is configured to automatically detect a type of external dimming device coupled to the first and second interface terminals based on the measured control voltage across the first and second interface terminals and the measured amount of current consumed by the dimming interface circuit.

* * * * *